United States Patent [19]

Lacam et al.

[11] Patent Number: 4,602,608

[45] Date of Patent: Jul. 29, 1986

[54] SUPPLY APPARATUS FOR A SEMI-AUTOMATIC COMPRESSED GAS DEVICE WHICH FIRES PROJECTILES

[75] Inventors: Jean S. Lacam, Terrenoire; René E. Pons, Saint Etienne; Pierre J. Simand, Saint Marcellim en Forêt, all of France

[73] Assignee: Etat Francais represente par le Delegue General pour l'armement, Paris Armees, France

[21] Appl. No.: 614,759

[22] Filed: May 29, 1984

[30] Foreign Application Priority Data

Jun. 1, 1983 [FR] France ..... 83 09037

[51] Int. Cl.[4] ..... F41C 19/00; F41C 25/00; F41B 11/00; F41B 9/00

[52] U.S. Cl. ..... 124/74; 124/76; 124/51 R; 124/31; 124/82

[58] Field of Search ..... 124/51 R, 53, 45, 52, 124/70, 74, 76, 82

[56] References Cited

U.S. PATENT DOCUMENTS

| | | | |
|---|---|---|---|
| 2,592,838 | 4/1952 | Wells | 124/51 R |
| 2,817,328 | 12/1957 | Gale | 124/53 X |
| 2,940,438 | 6/1960 | Merz | 124/76 |
| 3,103,212 | 9/1963 | Merz | 124/76 |
| 3,572,310 | 3/1971 | Chiba | 124/53 X |
| 3,818,887 | 6/1974 | Akiyama et al. | 124/53 X |
| 3,824,981 | 7/1974 | Crane et al. | 124/53 X |
| 4,116,193 | 10/1978 | Chiba | 124/51 R X |
| 4,164,929 | 8/1979 | Liepins et al. | 124/82 X |
| 4,173,211 | 11/1979 | Crawford | 124/45 |

*Primary Examiner*—Robert A. Hafer
*Assistant Examiner*—D. Neal Muir
*Attorney, Agent, or Firm*—Parkhurst & Oliff

[57] ABSTRACT

A supply mechanism for gas projectile firing devices includes: a magazine having a storage column for projectiles and a transfer slide for moving projectiles from a column to a position in line with the firing chamber; a mobile element having a transfer bar for moving the transfer slide from the column to its position next to the firing chamber, an insertion piston for moving projectiles from the transfer slide into the firing chamber and a firing pin for opening the valve connecting the compressed gas reservoir to the firing chamber; a trigger which activates the firing and prevents double insertion of a projectile, and a cocking rod which controls the mobile element and the trigger. The mechanism is applicable to training and sports weapons, and to nail and staple guns.

7 Claims, 6 Drawing Figures

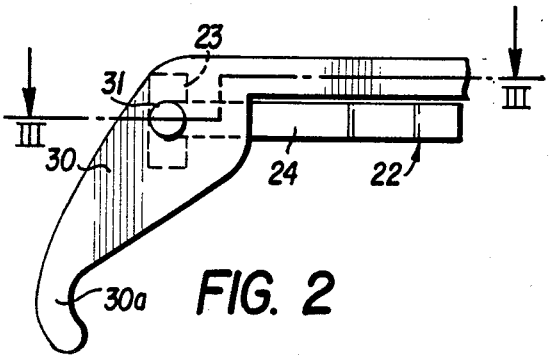
FIG. 2
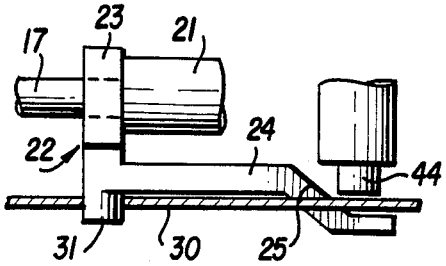
FIG. 3
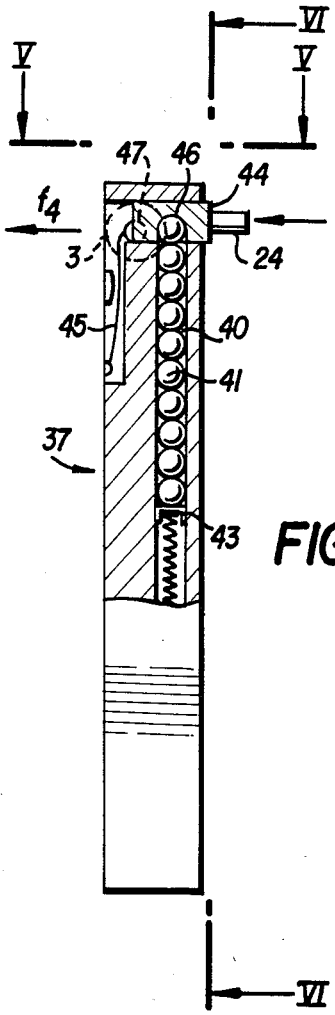
FIG. 4
FIG. 5
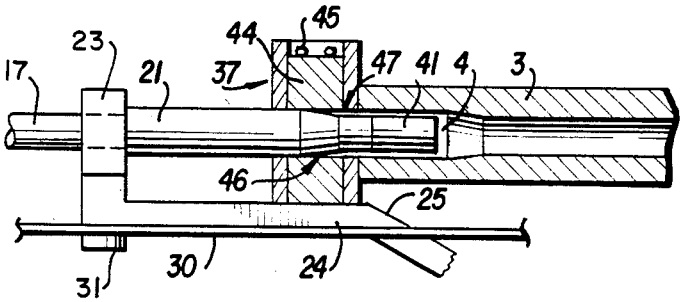
FIG. 6
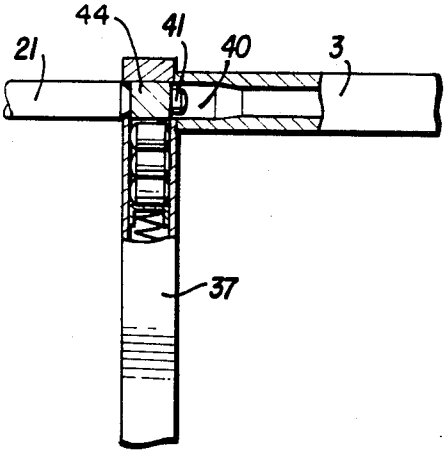

SUPPLY APPARATUS FOR A SEMI-AUTOMATIC COMPRESSED GAS DEVICE WHICH FIRES PROJECTILES

BACKGROUND OF THE INVENTION

This invention relates to the feeding apparatus for the operation of compressed gas firing devices for various projectiles in a semi-automatic mode.

This invention pertains both to devices which fire nails and the like, such as nail or staple guns, and weapons, such as those which fire malleable-matter base projectiles, e.g., lead, for shooting practice or sports.

Prior art feeding systems are usually designed around the function of the particular projectile being used. These apparatus, more specifically, call for either gravity-based feeding or feeding through a band or other collection of inter-connected projectiles, in order to provide a form of cohesion or mechanical standard for placement of the projectiles inside a guidance channel.

These two systems are unsatisfactory because the former is basically reserved for spherical projectiles, while the latter automatically require a pre-conditioning of the projectiles that have to be fired.

There are also feeding systems which are set aside more particularly for specific devices by employing cylinder-shaped reserves for the projectiles, e.g., a revolver. Such systems are not altogether satisfactory because a cylinder reserve requires significant clearance and has restricted projectile storage capacity. Furthermore, it is necessary to plan inside the cylinder immobilization means that are specific to the projectiles which, in some instances, might display variable external shapes, while meeting a global criterion of identical caliber.

SUMMARY OF THE INVENTION

This invention is designed to remedy the above disadvantages by providing a new feeding apparatus for the semi-automatic compressed gas firing of projectiles of various shapes.

The purpose of the invention is to provide a new feeding system for placement of a projectile to be fired by means of a simple intervention at the regular control trigger, while preventing a dual introduction of such projectiles inside the firing chamber.

An additional purpose of the invention is to provide a feeding apparatus which makes it possible, during one single maneuver, to introduce or position a projectile, then to fire it without a chance of false maneuver.

Another purpose of the invention is to provide the various above functions with projectiles that might be viewed as having the same general caliber but which display external configuration variations.

In order to attain the above goals, the feeding apparatus according to the invention is characterized in that it includes:

- a feeding magazine which includes:
  - a projectile storage column,
  - a transfer slide between the column and an aperture that is placed in line with the open section of the firing chamber,
- a mobile element which includes:
  - an insertion piston with an elastic recall that slides along the axis of the firing chamber, positioned on the opposite side of the magazine slide from the firing chamber,

- an opening firing pin which controls the valve,
  - a transfer bar which works on the slide,
- a cocking rod which connects a control member to the insertion piston and/or to the transfer bar,
- and a sear with an elastic recall that is activated by the cocking rod and which locks or releases the mobile element.

This invention may be used for firing projectiles of all kinds, depending on the application of the apparatus of the invention.

BRIEF DESCRIPTION OF THE DRAWINGS

A preferred embodiment of the present invention will be described with reference to the drawings, in which like numbers designate like items:

FIG. 2 is a lateral elevation which illustrates at a larger scale a detail of the apparatus shown in FIG. 1.

FIG. 3 is a plane view along line III—III in FIG. 2.

FIG. 4 is a partly cutaway cross section along line IV—IV in FIG. 1.

FIGS. 5 and 6 are schematic views along lines V—V and VI—VI in FIG. 4 which illustrate two specific operating phases of the subject of the invention.

DETAILED DESCRIPTION

Figure 1A:
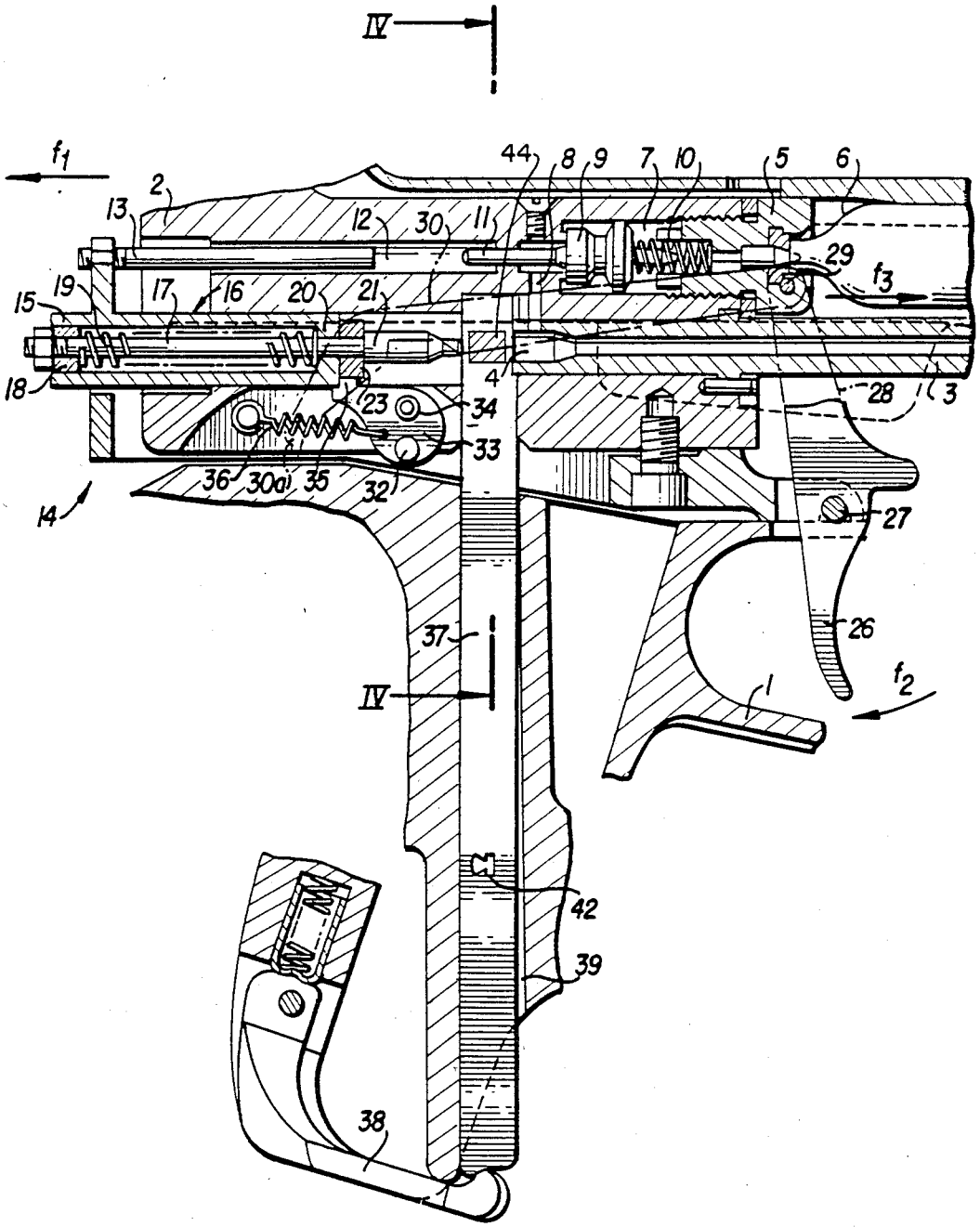
FIGS. 1*a* and 1*b* are lateral elevational sectional views different stages of a feeding apparatus according to the invention.

FIG. 1 shows the body 1 of a semi-automatic compressed gas device which fires non-explosive projectiles, for example, those made of a malleable metal. Such a device could be a nail gun, staple gun, or the like, or a practice or sports weapon, including, without limitation, a carbine or pistol.

The body 1 supports a casing 2 which contains the entire mechanism as well as a firing barrel 3 which includes inside the casing 2 a chamber 4. The casing 2 includes, for example at its upper part, a joint 5 for assembling a compressed gas reserve 6 that can be comprised of any appropriate kind of cartridge. The joint 5 leads into a transfer chamber 7 that communicates through a duct 8 with the firing chamber 4. The duct 8 is controlled by a valve 9 of the piston type which is biased towards the closed position by an elastic member 10. The valve 9 is extended by a control needle 11 that leads into a bore 12 formed in the casing 2. The bore 12 is reserved for the passing of a hammer 13, of the throw type, which is borne by a mobile element 14 that is arranged along the axis of the barrel 3 away from the rear section of the latter, i.e., to the rear of the firing chamber 4. The element 14 includes a carriage 15 that is guided by sliding axially in a slide 16 formed in the casing 2. The carriage 15 supports a cylindrical rod 17 the rear end of which is equipped with an abutment 18. A spring 19 is mounted concentrically on the rod 17 between the abutment 18 and the forward section 20 of the carriage 15 so as to bias the rod 17 in the direction of arrow $f_1$. The spring 19 has a lower spring constant than that of the spring 10, i.e., it is weaker than the spring 10.

The rod 17 is the tail of an insertion piston 21 which is directed towards the firing chamber 4 of the barrel 3. The piston 21 is associated, at its base, with a transfer bar 22 that includes a yoke 23 which is free to slide axially on the tail 17 by being disposed between the base of the piston 21 and the forward side of the carriage 15. The transfer bar 22 includes a branch 24 which extends towards the barrel 3 in parallel with the axis of the latter, but latterally shifted therefrom. The branch 24 also includes an insertion ramp 25, the function of which will be discussed below.

The feeding apparatus also includes a trigger 26 which is mounted on and articulated about an axis 27 attached to the casing 2. The trigger 26 is extended inside the casing 2 by lever 28, which is articulated by an axis 29 onto a cocking rod 30, which appears in dashed lines in FIG. 1 and is illustrated in more detail in FIGS. 2 and 3. The cocking rod 30 is also mounted on a trunnion 31 which is formed by the yoke 23 of the transfer bar 22. Beyond the trunnion 31, the cocking rod constitutes a branch 30*a* which extends backwards in alignment with a lug 32 formed on a sear 33, which is mounted and free to pivot on an axis 34 borne by the casing 2. The sear 33 is arranged below the piston 21 and includes a lug 35 designed to cooperate, as a holding abutment, with the forward section of the carriage 15. FIGS. 2 and 3 indicate that the cocking rod 30 extends laterally to and partially overlaps the branch 24 of the rod 22 so as to form a guidance and abutment element preventing rotation of the yoke 23 about the tail 17 of the piston 21.

The apparatus also includes a storage magazine 37 which is designed to be mounted and maintained, for example with a lever 38, inside a lodging 39 formed in the body 1 and/or the casing 2, as schematically illustrated in FIG. 4. The inside of the magazine 37, has a storage column 40 which is designed to contain and delimit the projectiles 41 that can be inserted in the column 40 through a packing window 42. As shown in FIG. 1, this window can be designed to perform an aligning function in the event that the projectiles which are used are not symmetrical about a median transverse plane.

The column 40 has associated therewith a spring elevation 43 which can be maneuvered manually during the packing operation. The elevator 43 pushes the pile of projectile 41 which is in column 40 towards a transfer and display slide 44 which is located in the upper part or at the head of the magazine. With pressure against it from an elastic member 45 of the pin type, the transfer slide 44 can assume two stable positions in the first of which a lodging 46 formed in the slide 44 is aligned with the axis and above the open section of the column 40, and in the second of which the lodging 46 is aligned with an aperture 47 fitted at the top of the magazine 37 along an axis that is perpendicular to that of the column 40 and laterally shifted in relation thereto.

The magazine lodging 39 is so planned that the aperture 47 is constantly positioned in line with the open section of the chamber 4 and such that slide 44 takes up a plane which corresponds more or less to that of the branch 24 of the transfer bar 22. Furthermore, this lodging 39 is fitted so that the top of the magazine 37 is placed between the open section of the chamber 4 and the piston 21.

The feeding apparatus described above operates in the following manner:

As shown in FIG. 1, the spring 36 holds the sear 33 in its upwardly tilted posture wherein the lug 35 abuts the yoke 23 and constitutes an abutment for the carriage 15. The mobile element 14 is held in a recoil position with the insertion piston 21 withdrawn from the magazine 37.

The magazine 37, which is properly fitted with projectiles 41, is immobilized in a stable position by the lever 38. In that state, the transfer slide 44 takes the position shown in FIG. 4 with the lodging 46 in line with the axis of the column 40. Due to the activity of the elevator 43, the first projectile 41 is inserted inside the lodging 46.

If the person firing exerts force in the direction of arrow $f_2$ on the trigger 26, the branch 28 prompts the cocking rod 30 in the direction of arrow $f_3$. Through the trunnion 31, the cocking rod 30 shifts the piston 21 and the tail 17 in relation to the carriage 15, which is immobilized in the waiting position by the lug 35 of the sear 33. This sliding of the piston 21 and the rod 17 in the direction opposite that of arrow $f_1$ causes compression of the elastic member 19.

The shift of the piston 21 and of the transfer bar 22 also means that the ramp 25 acts on the slide 44 to shift it in the direction of arrow $f_4$ (FIG. 4). This brings the packed lodging 46 in line with the aperture 47 at the same time that the piston 21 arrives in its insertion phase. The projectile 41, which packs the lodging 46 and is appropriately displayed facing the chamber 4, is then inserted inside the chamber 4 by an axial thrust from the piston 21, as shown in FIG. 5.

Figure 1B:
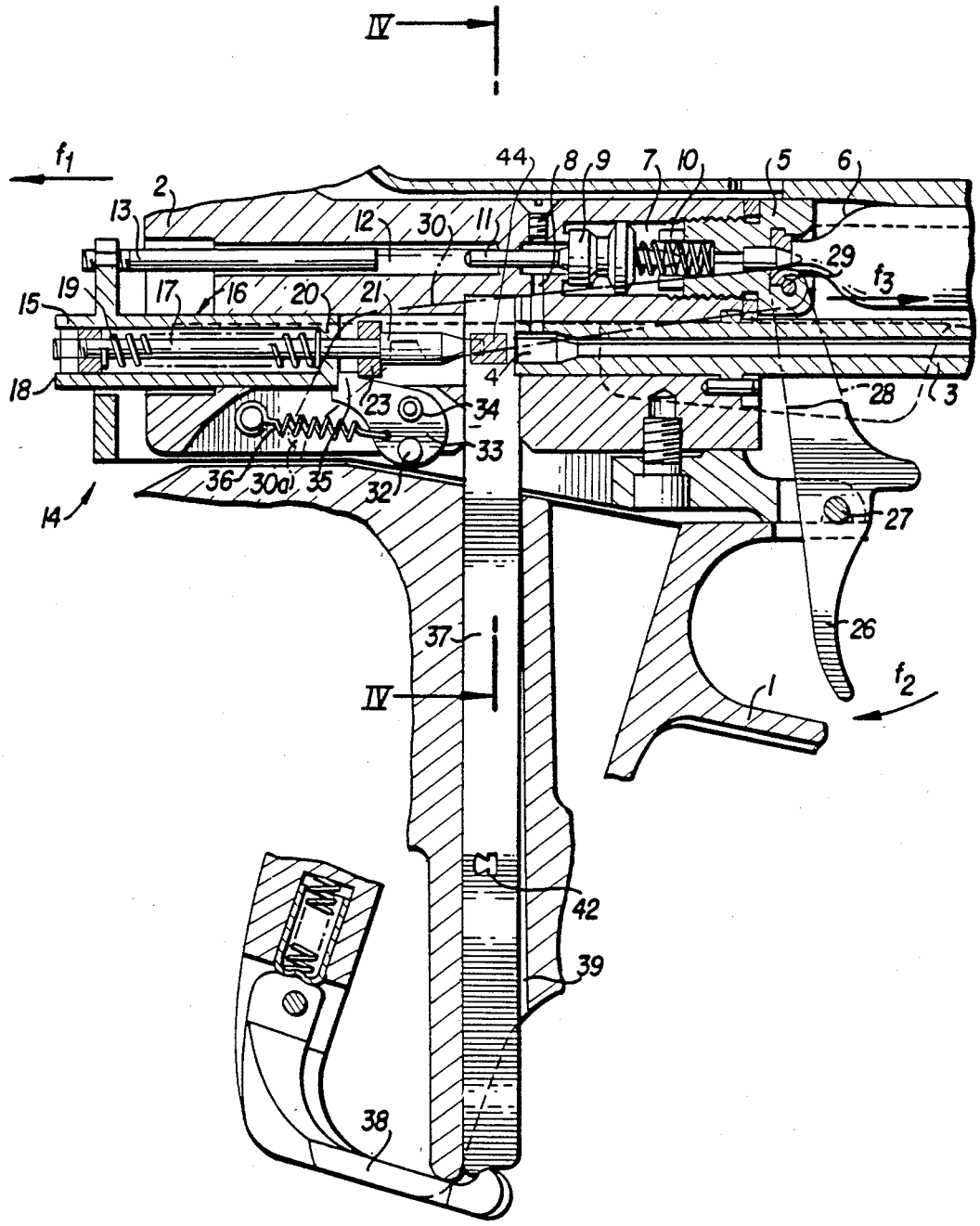

As soon as the axial shift of the yoke 23 of the bar 22 is adequate, the lug 35 fits between it and the forward side of the carriage 15 through a rotation of the sear 33 under pressure from the spring 36 as illustrated in FIG. 1*b*.

Assuming that in this state the person firing releases his action on the trigger 26, the piston 21 is prompted in the direction of arrow $f_1$ by recovering work stored by the spring 19. However, the piston cannot return past the abutment of the lug 35, which is resting against the carriage 15. Hence, the piston 21 stays at least partially engaged inside the lodging 46 of the slide 44 which is held by the ramp 25 in the display position with a projectile facing the chamber 4, as shown in FIG. 6.

This constitutes a positive safety which prevents any chance of display and insertion of two successive projectiles, when the firing of the first did not intervene as a result of too weak an action on the trigger 26.

Assuming that the person firing pursues his action in the direction of arrow $f_2$ on the trigger 26, the branch 30*a* of the cocking rod 30 comes into contact with the lug 32 and it then prompts the sear 33 in a reverse pivoting against the action of the spring 36. This removes the lug 35 from contact with the forward side of the carriage 15, which is then cast into a slide by the spring 19 until is resumes positive contact with the yoke 23 of the bar 22. The hammer 13 is shifted in the same direction into the bore 12 and hits the needle 11 of the valve 9. This percussion occurs when the projectile 41 is completely inserted inside the chamber 4. The opening of the valve 9 releases a load of compressed gas, which is conveyed by the duct 8 to the rear section of the chamber 4, which is closed by the top of the magazine 37 and by the piston 21. This load of compressed fluid produces the launching of the projectile 41, which is forced to follow the barrel 3.

The load of compressed fluid which stems from the reserve 6 is issued only for a brief spell, since the spring 10 embodies a force which is greater than that of spring 19. As soon as the kinetic energy stemming from the launching of the element 41 has been absorbed, the spring 10 pushes back the valve 9, which interrupts the communication between the reserve 6 and the chamber 4.

In the above mentioned operating phase, it is stated that the operator acts, at first, to produce the display and insertion of a projectile and then, in a second phase, to ensure the launching and the firing of the latter. It should be understood that these two successive phases normally unfold in a continuous sequence, from the time that the operator exerts constant action on the trigger 26 for the purpose of making it travel the entire useful course which is assigned to it.

When the user removes his action from the trigger 26, a spring (not shown) prompts the rod 17, the piston 21 and the yoke 23 in the direction of arrow $f_1$ and recalls the mobile element 14 to the end position of its recoil, as shown in FIG. 1. The yoke 23 is applied anew against the forward side of the carriage 15, so that the piston 21 is released from the lodging 46, while the ramp 25 is removed from the slide 44. The spring 45 returns the slide 44 to the loading posture for a new projectile 41, which is pushed inside the lodging 46 by the elevator 43.

The return of the mobile element 14 to a recoil position allows the trigger 33 to pivot under the action of the spring 36 to pull the lug 35 back into an abutment position in relation to the forward side of the carriage 15 and in contact with the yoke 23.

The entire feeding apparatus is ready to operate anew, as described above, as soon as the opertor acts on the release 26.

A semi-automatic operation is possible, from a storage magazine which is packed with projectiles which are independent of one another and a compressed fluid reserve.

The feeding apparatus represents a viable, sturdy, cost effective unit which is able to ensure the general feeding of projectiles with various external shapes, of the same caliber, without risking the double insertion and jamming resulting from a false maneuver.

The feed apparatus is especially designed for implementation in the feed of weapons which fire bullets made of malleable matter that are used for target practice or sport shooting, as well as for training in combat weapon handling.

The invention is not restrictd to the example which was described and represented, as various amendments can be made to it without exceeding its scope. It should be understood that many technical equivalents can be substituted for the described and depicted means, for example, the apparatus might include a firing pin of the striking kind.

What is claimed is:

1. A semi-automatic weapon for firing projectiles with a compressed gas device, the weapon having a mechanism casing in which a launching barrel is positioned and comprising:

an open reception chamber on one end of the launching barrel;

compressed gas reservoir means communicating with said open reception chamber;

an elastic recall valve biased to the closed position for monitoring a passage between the reservoir means and the open reception chamber;

a readily removable supply magazine with a column for storing said projectiles, said supply magazine being provided at its head with a transfer slide movable between said column and an aperture which is located in line with said open reception chamber, and with spring means for biasing said slide towards said column;

a mobile element having an insertion piston movable along an axis of said reception chamber, said mobile element comprising an elastic recall means for biasing said piston towards its rear position, a hammer for controlling said valve, and a transfer bar for moving said transfer slide toward said aperture, said piston being movable from said mobile element by a cocking rod connected to a trigger and said transfer bar; and a sear having elastic recall means, said mobile element being locked and released by said sear provided with elastic recall means, said sear being movable by said cocking rod.

2. An apparatus according to claim 1, wherein the supply magazine further comprises elevator means for biasing any projectiles stored in said column towards a head opening of said column, and wherein the transfer slide has a lodging formed therein for a projectile such that the lodging aligns with the head opening when the transfer slide is in line with the column and aligns with the aperture when the slide is in line with the aperture, said aperture also being in line with said insertion piston and said open reception chamber.

3. An apparatus according to claim 1, further comprising a tail extending from an abutment of said insertion piston and slidably connected to said transfer bar such that said transfer bar can move said piston by pressing against said abutment, said piston being moved to a first position at an end of said chamber opposite said barrel.

4. An apparatus according to claim 1, wherein said transfer bar further comprises an inclined ramp portion which is shifted laterally in relation to the axis of said open reception chamber for moving said transfer slide towards said die.

5. An apparatus according to claim 1, wherein said elastic recall means of said sear biases the sear towards a locking position and said cocking rod moves said sear to a release position by pressing against a lug formed on said sear.

6. An apparatus according to claim 1, wherein said sear further comprises a lug for cooperating with a front abutment of said mobile element and a rear abutment of said transfer bar to prevent said mobile element from moving forward and said transfer bar from moving backward more than a predetermined distance whenever said lug is interposed between said front and rear abutments, and wherein said elastic recall means of said sear causes said lug to be so interposed whenever said transfer bar moves forward by move than the predetermined distance.

7. A semi-automatic weapon for firing projectiles with a compressed gas device, said weapon having a mechanism casing in which a launching barrel is positioned and comprising:

an open receiption chamber at one end of said launching barrel;

compressed gas reservoir means communicating with said open reception chamber;

an elastic recall valve baised to the closed position for monitoring a passage between the reservoir means and the open reception chamber;

a readily removable supply magazine with a column for storing said projectiles;

a mobile element having an insertion piston movable along an axis of said reception chamber; and a sear having elastic recall means for urging said sear in one pivoting direction;

said weapon further comprising a cocking rod connected to a transfer bar, both said cocking rod and transfer bar being driveable by a trigger, said transfer bar being associated with a transfer slide of a magazine and movable between said column and an aperture located in line with said open reception chamber, said cocking rod being associated with said insertion piston for moving said piston from said mobile element, said cocking rod thereafter prompting said sear in a reverse pivoting direction and releasing a hammer integrated with said mobile element to contact said valve for releasing a load of compressed gas.

* * * * *